United States Patent [19]

Flock et al.

[11] 4,231,664

[45] Nov. 4, 1980

[54] METHOD AND APPARATUS FOR COMBINING HIGH SPEED HORIZONTAL AND HIGH SPEED VERTICAL CONTINUOUS MIXING OF CHEMICALLY BONDED FOUNDRY SAND

[75] Inventors: Steven D. Flock, Beaverton; Roger A. Hayes, Tigard, both of Oreg.

[73] Assignee: Dependable-Fordath, Inc., Sherwood, Oreg.

[21] Appl. No.: 22,609

[22] Filed: Mar. 21, 1979

[51] Int. Cl.[3] ..... B01F 7/04; B01F 7/08; B01F 7/24

[52] U.S. Cl. ..... 366/35; 366/52; 366/65; 366/66; 366/156; 366/310; 366/329

[58] Field of Search ..... 366/33, 35, 38, 156, 366/181, 20, 52, 65, 66, 156, 310, 329

[56] References Cited

U.S. PATENT DOCUMENTS

| | | | |
|---|---|---|---|
| 3,580,326 | 5/1971 | Edwards | 366/156 |
| 4,037,826 | 7/1977 | Mills | 366/156 |
| 4,039,169 | 8/1977 | Gordon | 366/20 |
| 4,056,259 | 11/1977 | Richard | 366/38 |

*Primary Examiner*—Robert W. Jenkins
*Attorney, Agent, or Firm*—Klarquist, Sparkman, Campbell, Leigh, Hall & Whinston

[57] ABSTRACT

The specification discloses a method and apparatus for combining high speed horizontal and high speed vertical continuous mixing of sand and binder ingredients for mold making purposes. Sand supplied by a hopper assembly and liquid binder ingredients supplied by injection assemblies are fed into the rearward ends of a pair of side-by-side, horizontally extending cylindrical mixing chambers. They are rapidly mixed and conveyed forwardly by blade assemblies which extend centrally through the horizontal mixing chambers and are rotated at from about 300 rpm to about 1500 rpm. The mixtures are then discharged into a vertically extending cylindrical mixing chamber where they are rapidly mixed by a blade assembly which extends centrally through the vertical mixing chamber and is rotated at from about 300 rpm to about 800 rpm. The final mixture is then discharged from the vertical mixing chamber downwardly into a mold box.

8 Claims, 11 Drawing Figures

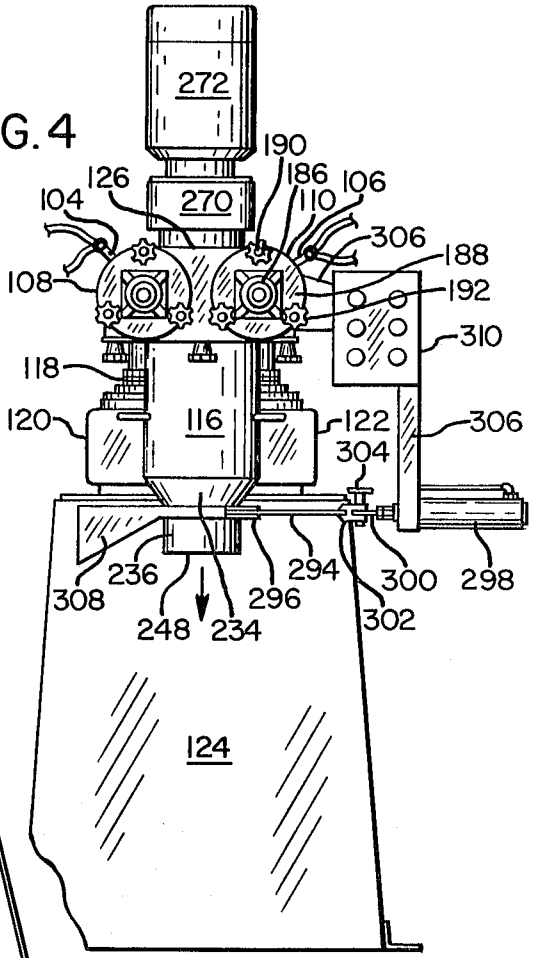
FIG. 4
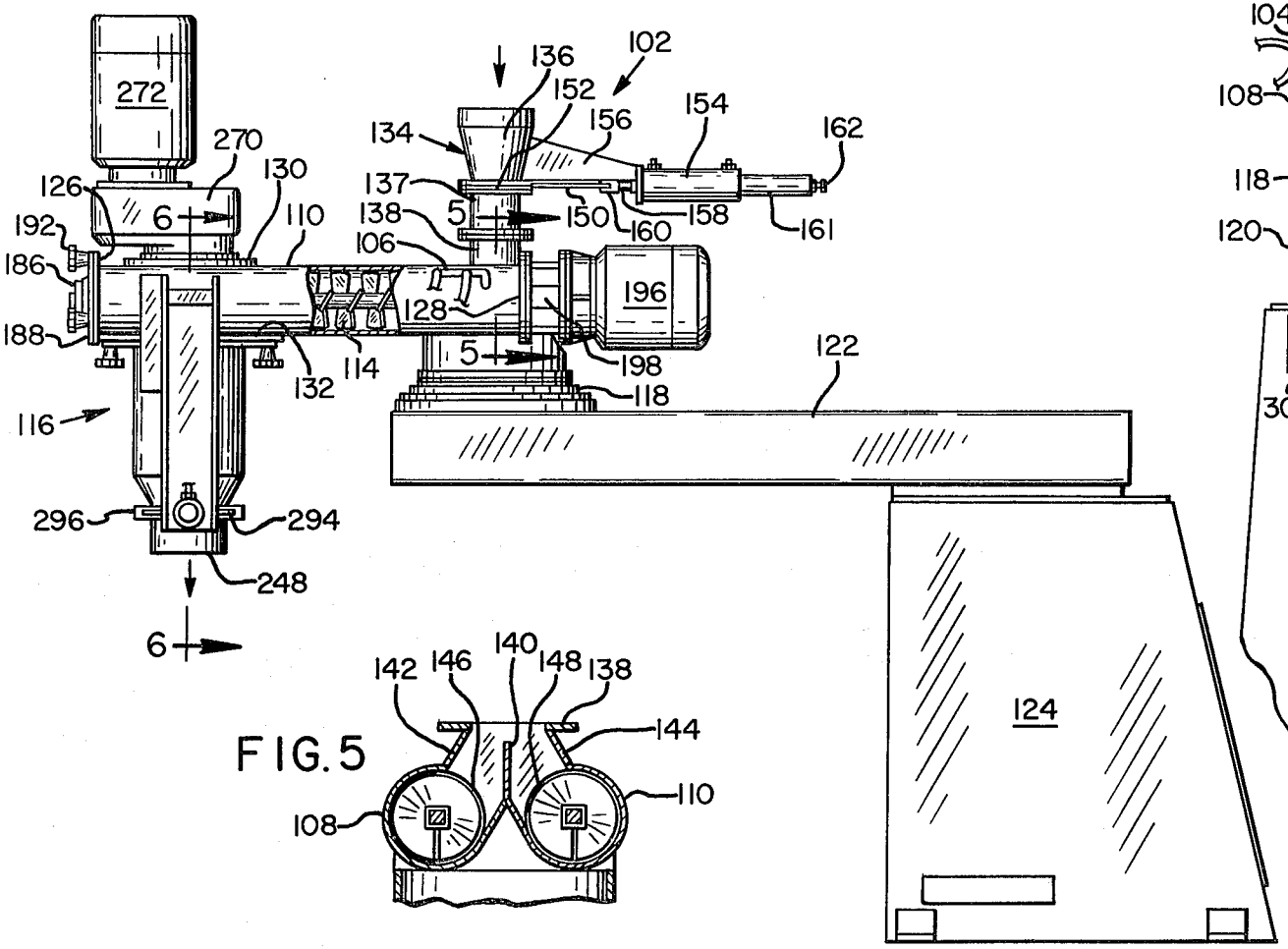
FIG. 3
FIG. 5

METHOD AND APPARATUS FOR COMBINING HIGH SPEED HORIZONTAL AND HIGH SPEED VERTICAL CONTINUOUS MIXING OF CHEMICALLY BONDED FOUNDRY SAND

BACKGROUND OF THE INVENTION

The present invention relates to foundry methods and equipment, and more particularly to a method and apparatus for combining high speed horizontal and high speed vertical continuous mixing of sand and binder ingredients for mold making purposes.

In the past, sand molds employed to cast metal objects have been produced by bonding the sand with clay, bentonite, sodium silicate or other such binders. Sand molds produced with these binders have generally been made by two different methods. One method involves pressing the sand/binder mixture into a metal flask which surrounds the mold during the molten metal pouring operation. A second method involves baking the sand mold to a hardened condition.

Recently, the foundry industry has begun to use a wide variety of quick setting resin binders. They have allowed sand molds of high quality to be rapidly produced without using metal flasks and without baking. Liquid binder ingredients (resin and catalyst) are mixed with sand and the mixture is poured into an open-top mold box containing a mold pattern. After being leveled and slightly compacted the mixture hardens in a relatively short time, e.g. 70 seconds. The hardening time depends upon the type of resin, the relative proportions of the ingredients, the temperature of the environment, etc. The completed mold may thereafter be removed or stripped from the mold box at which time it is ready for the molten metal pouring operation.

Conventional batch mullers have been used to mix sand, resin, and catalyst. Pre-measured quantities of the ingredients are poured into an open container and mixed by rotating blades. The average time needed for thorough mixing is generally on the order of several minutes. The mixture has a tendency to pre-cure in such batch mullers. If lumpy mixture is discharged into a mold box the resulting mold is unsuitable for casting. Furthermore, such batch mullers are incapable of continuously supplying sand/binder mixture. If a mold box requires more mixture than the batch size, additional batches must be prepared. The first batch poured into a mold box can harden before the second batch is poured over the same. The resulting sand mold is stratified and is unsuitable for casting.

Continuous mixers have recently become available to the foundry industry. Sand, binder and catalyst can be routed through these mixers and poured into mold boxes in a more or less continuous fashion. They generally incorporate one or more tubular mixing chambers each having a central rotating shaft which carries mixing blades. The shafts in various mixers are rotated at different speeds. As used herein, the term low speed refers to an rpm (revolutions per minute) of approximately 100 or less. The term high speed refers to an rpm of approximately 300 or more.

In a single stage continuous mixer, the sand, resin and catalyst are all mixed together in a single mixing chamber. This chamber is either horizontal or vertical, i.e. the blade carrying shaft extends either horizontally or vertically. In the case of a horizontal mixing chamber, the blade carrying shaft is rotated in some mixers at low speed and in other mixers at high speed. In the case of a vertical mixing chamber the blade carrying shaft is typically rotated at high speed.

In a two stage continuous mixer multiple mixing chambers are interconnected. The mixing chambers are either all horizontal or a combination of horizontal and vertical. In the former, the blade carrying shafts are all rotated at low speed in some mixers and are all rotated at high speed in other mixers. In the latter, the blade carrying shafts in the horizontal mixing chambers are rotated at low speed and the blade carrying shafts in the vertical mixing chambers are rotated at high speed. One sand mixer has utilized high speed pre-mixing in horizontal chambers which discharge into a slow speed vertical batch mixer. Heretofore, there has not been a method and apparatus for combining high speed horizontal and high speed vertical continuous mixing of sand and binder ingredients for mold making purposes.

SUMMARY OF THE INVENTION

It is an object of the present invention to provide a method for combining high speed horizontal and high speed vertical continuous mixing of sand and binder ingredients for mold making purposes.

It is another object of the present invention to provide an apparatus for combining high speed horizontal and high speed vertical continuous mixing of sand and binder ingredients for mold making purposes.

It is another object of the present invention to provide a continuous foundry mixer that can rapidly mix in four to five seconds sand and resin, sand and catalyst, and then the sand/resin and sand/catalyst mixtures.

It is another object of the present invention to provide a continuous mixer which can be rapidly purged of mixed materials.

It is still a further object of the present invention to provide a continuous mixer that will allow the types and quantities of materials to be mixed to be rapidly changed.

It is yet another object of the present invention to provide a continuous mixer which will allow facing and backing sand to be rapidly poured in the same mold box without stratification occurring.

It is a further object of the present invention to provide a continuous mixer which will permit wide variations in throughput while still achieving thorough mixing.

It is yet another object of the present invention to provide a combination horizontal and vertical continuous foundry mixer which has simple, individually replaceable horizontal blade assemblies.

It is still another object of the present invention to provide a continuous foundry mixer adapted for filling mold boxes of varying heights carried in succession along a pathway.

The present invention provides a method and apparatus for combining high speed horizontal and high speed vertical continuous mixing of sand and binder ingredients for mold making purposes. Sand supplied by a hopper assembly and liquid binder ingredients supplied by injection assemblies are fed into the rearward ends of a pair of side-by-side, horizontally extending cylindrical mixing chambers. They are rapidly mixed and conveyed forwardly by blade assemblies which extend centrally through the horizontal mixing chambers and are rotated at from about 300 rpm to about 1500 rpm. The mixtures are then discharged into a vertically extending cylindrical mixing chamber where they are rapidly mixed by a blade assembly which extends centrally through the vertical mixing chamber and is rotated at from about 300 rpm to about 800 rpm. The final mixture is then discharged from the vertical mixing chamber downwardly into a mold box.

BRIEF DESCRIPTION OF THE DRAWINGS

FIG. 3 is a side elevational view of an apparatus forming one embodiment of the mixer of the present invention, with portions broken away;

FIG. 4 is a front end elevational view of the apparatus of FIG. 3;

FIG. 5 is an enlarged vertical sectional view taken along line 5—5 of FIG. 3;

DESCRIPTION OF THE PREFERRED EMBODIMENT

In order to enable the reader to more fully understand the present invention together with its objects and advantages an overall description of the structure and operation of a multi-station sand mold making apparatus incorporating the invention will initially be set forth. Thereafter will follow a detailed description of the present invention.

Figures 1, 2A, 2B, 6:
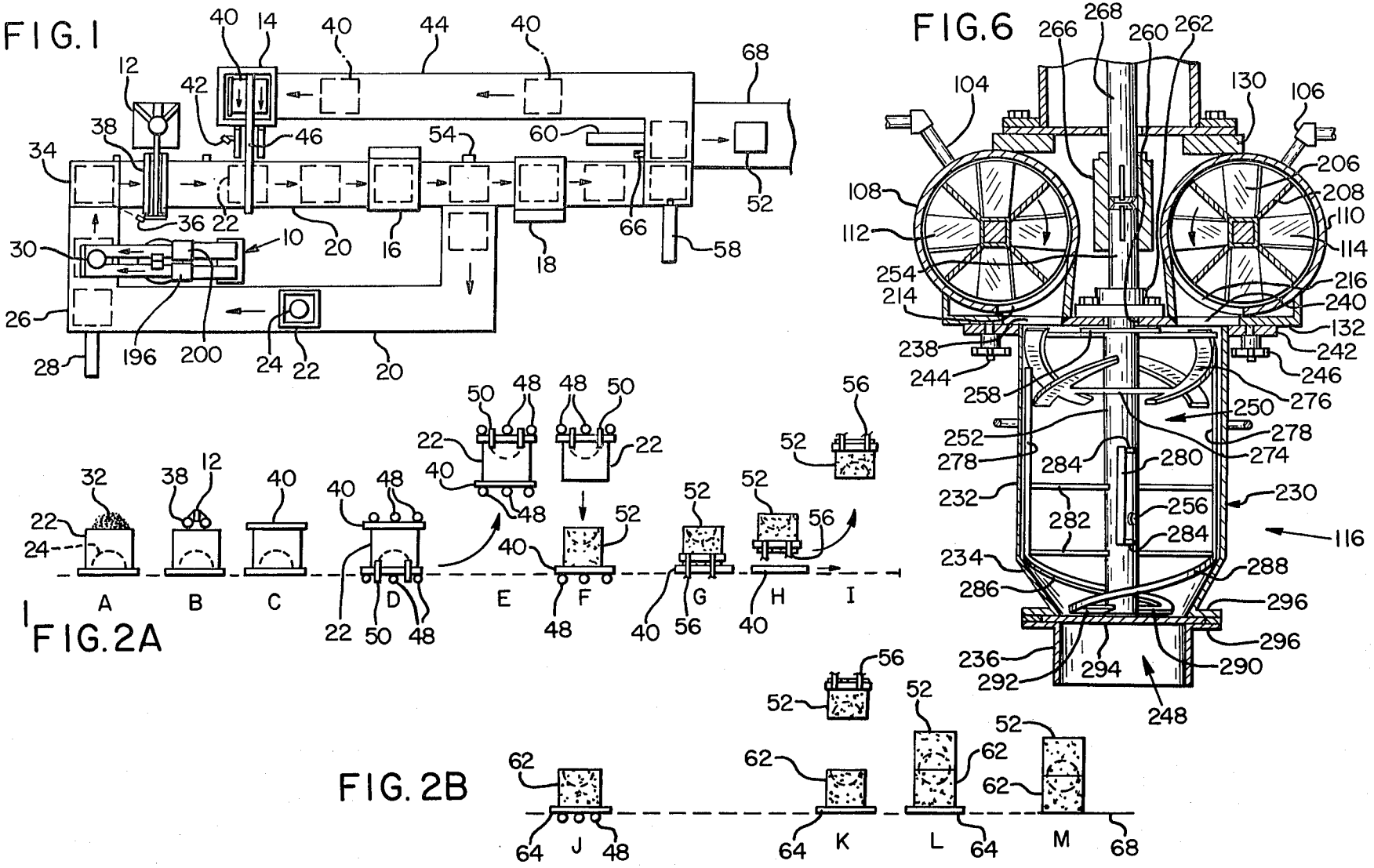
FIG. 1 shows a simplified plan view of a multi-station sand mold making apparatus which utilizes one embodiment of the mixer apparatus of the present invention at one station.
FIG. 2A shows a functional diagram illustrating the manner in which the multi-station sand mold making apparatus of FIG. 1 forms a cope portion of a composite sand mold.
FIG. 2B shows a functional diagram illustrating the manner in which the multi-station sand mold making apparatus of FIG. 1 joins a cope portion and a drag portion to form a composite sand mold.
FIG. 6 is an enlarged vertical sectional view taken along line 6—6 of FIG. 3 with the mixing head sand gate cylinder and arm omitted.

Referring to FIGS. 1, 2A and 2B, a mixer apparatus 10 constructed in accordance with the present invention, a strike off apparatus 12, a bottom board feeder apparatus 14, a roll over draw apparatus 16, and a roll over close apparatus 18 are stationed successively along a pathway or main conveying line 20 of intermittently powered conveying rollers. A plurality of open-top mold boxes of varying heights such as 22, being alternately cope and drag boxes, travel in a clockwise direction around the main conveying line 20. Each mold box contains a pattern such as indicated at 24.

First described will be the formation of a cope portion of a mold. When the mold box 22 reaches the corner 26 of the main conveying line 20 a pneumatic cylinder 28 pushes the mold box beneath the discharge end 30 of the mixer 10. A predetermined amount of sand 32 mixed with resin and catalyst is automatically poured into the mold box (FIG. 2A, step A). The mold box is simultaneously vibrated to eliminate voids and produce some compaction of the sand. The amount of sand which is poured into the mold box is sufficient to form a mound which extends above the upper edges of the box.

Each mold box may have a metal strip affixed to its underside. The location of the strip serves as an indicator of the volume of the mold box. When the mold box is underneath the discharge end of the mixer apparatus the location of the strip is sensed by a proximity sensor in order to determine the quantity of sand which is to be poured into the mold box.

Next, the mold box 22 containing the mound of sand 32 is conveyed to a corner 34 of the main conveying line 20 where it momentarily stops. After a time delay, the mold box 22 leaves the corner 34 and travels toward the strike off apparatus 12. An infrared proximity sensor 36, mounted on an assembly supporting a pair of rollers 38, is activated. At this point the rollers 38 are at their upper limit of movement and an elevating mechanism lowers the roller assembly, and the sensor 36 until its horizontal scanning beam is intercepted by the mound of sand 32 in the mold box. This is done before the box reaches the rollers. The rollers 38 stop at a height so that they ride over the sand in the mold box as the box passes thereunder (FIG. 2A, step B). The sand is leveled and slightly compacted by the rollers. After the mold box has passed under the rollers they are raised to their original positions and the strike off apparatus awaits the next succeeding box.

Next, the mold box 22 is conveyed along the pathway 20 to the bottom board feeder apparatus 14 where it momentarily stops in position for receiving a bottom board such as 40. An infrared proximity sensor 42 mounted on the board elevating mechanism of the bottom board feeder apparatus senses the presence of the mold box 22. The bottom board 40 has already been conveyed along a return conveying line 44 of intermittently powered conveying rollers onto the bottom board feeder apparatus 14. The elevating mechanism of the bottom board feeder apparatus raises the bottom board 40 until the horizontal scanning beam of the sensor 42 is above the upper surface of the mold box 22. Thereafter, a shuttle mechanism 46 of the bottom board feeder apparatus feeds the bottom board laterally onto the top of the mold box (FIG. 2A, step C).

Next, the mold box 22, now covered with a bottom board 40, is conveyed along the main conveying line 20 to the roll over draw apparatus 16. The mold box 22 and the bottom board 40 are clamped between jaws of rollers 48 and arms 50 grip the bottom flange of the mold box (FIG. 2A, step D). The mold box 22 and the bottom board 40 are inverted, i.e. rolled over 180 degrees (FIG. 2A, step E). The now hardened cope portion 52 of the sand mold is lowered out of the mold box 22 with the aid of vibrating mechanisms by unclamping the jaws of rollers 48. (FIG. 2A, step F). The cope portion 52 and the bottom board 40 upon which it now rests are conveyed out of the roll over draw apparatus 16 and along the main conveying line 20 to the roll over close apparatus 18.

After the cope portion 52 and the bottom board 40 are conveyed out of the roll over draw apparatus 16, the mold box 22 is clamped between the rollers 48 and re-inverted, i.e. rolled over 180 degrees. The mold box 22 is then conveyed out of the roll over draw apparatus 16 to a box return mechanism 54 positioned between the roll over draw apparatus 16 and the roll over close apparatus 18. The mechanism 54 ejects the mold box 22 laterally and the mold box is returned along the main conveying line 20 to its original starting place.

Arms 56 of the roll over close apparatus 18 clamp the cope portion 52 and raise it off of the bottom board 40 (FIG. 2A, steps G and H). The bottom board 40 is conveyed out of the roll over close apparatus 18 to a position adjacent a pneumatic cylinder 58 which pushes the board laterally to a position adjacent a pneumatic cylinder 60. After the bottom board 40 is conveyed out of the roll over close apparatus 18, the cope portion 52 is inverted, i.e. rolled over 180 degrees (FIG. 2A, step I). The cope portion 52 is maintained in an elevated position above the level of the main conveying line 20 awaiting the arrival of a drag portion.

In a similar fashion, the multi-station sand mold making apparatus shown in FIG. 1 produces the drag portion 62 of the composite sand mold (FIG. 2B, step J), the steps being the same as steps A through F (FIG. 2A). The drag portion 62 and the bottom board 64 upon which it rests are then conveyed into the roll over close apparatus 18 directly underneath the waiting cope portion 52 (FIG. 2B, step K). The cope and drag portions 52 and 62 are joined (FIG. 2B, step L) and they are conveyed, resting on top of the bottom board 64, out of the roll over close apparatus 18 to a position adjacent the pneumatic cylinder 58. The pneumatic cylinder 58 pushes the bottom board 64, and the cope and drag portions 52 and 62 carried thereby, laterally to a position adjacent the pneumatic cylinder 60. The bottom board 64 pushes the bottom board 40 onto the return conveying line 44 and the powered conveying rollers thereof convey the bottom board 40 back to the bottom board feeder apparatus 14. An infrared proximity sensor 66 senses the presence of the completed sand mold and actuates the pneumatic cylinder 60 which pushes the joined cope and drag portions 52 and 62 down a chute 68 which leads to a metal pouring station (FIG. 2B, step M). The next succeeding bottom board that is pushed laterally by the pneumatic cylinder 58 will push the bottom board 64 laterally onto the return conveying line 44 which will return it to the bottom board feeder apparatus 14.

In actual operation a plurality of mold boxes and bottom boards are simultaneously circulated about the apparatus shown in FIG. 1. A continuous succession of composite sand molds assembled and ready for the molten metal pouring operation is produced.

THE MIXER APPARATUS

Turning now to a detailed description of the mixer apparatus of the present invention, referring generally to FIGS. 3, 4 and 6, sand supplied by a hopper assembly 102 (FIG. 3) and liquid binder ingredients supplied by injection assemblies 104 and 106 (FIGS. 3 and 6) are simultaneously fed into the rearward ends of a pair of side-by-side, horizontally extending cylindrical mixing chambers 108 and 110. They are rapidly mixed and conveyed forwardly by high speed, counter-rotating horizontal blade assemblies 112 and 114 (FIGS. 3, 6 and 7) extending centrally through the horizontal mixing chambers. The mixtures are then discharged from the forward ends of the mixing chambers downwardly into a high speed vertical mixing head 116 (FIG. 6) of the type shown and described in detail in U.S. Pat. No. 4,037,826. The final mixture is then discharged from the vertical mixing head 116 downwardly into the mold box 22 (FIG. 1).

The rearward ends of the horizontal mixing chambers 108 and 110 are supported by a turntable 118 (FIGS. 3 and 4) for 270 degree rotational movement in a horizontal plane over the main conveying line 20. The turntable 118 is in turn supported on the forward ends of a pair of side-by-side, horizontally extending box beams 120 and 122 (FIGS. 3 and 4). The rearward ends of the box beams 120 and 122 are rigidly secured to the top of a pump base 124 (FIGS. 3 and 4).

The opposite ends of the horizontal mixing chambers 108 and 110 are welded to oval plates 126 and 128 (FIGS. 3 and 4) which have circular holes therethrough coinciding with the bores or end openings of the chambers. Laterally extending upper and lower support plates 130 and 132 (FIGS. 3 and 6) are also welded to the outer walls of the mixing chambers 108 and 110 at their forward ends.

Feeder means are provided for rapidly introducing the materials to be mixed into the rearward ends of the horizontal mixing chambers 108 and 110. The hopper assembly 102 (FIG. 3) includes a tubular hopper 134 having an upper flared sand receiving section 136, an intermediate extension 137, and a lower Y-shaped section 138 (FIG. 5). The lower hopper section 138 has a centrally disposed, vertical dividing plate 140 which separates the upper ends of a pair of tubular legs 142 and 144 welded to the horizontal mixing chambers 108 and 110. Sand entering the lower hopper section 138 is divided by the plate 140. Equal amounts of sand flow through the legs 142 and 144 into the horizontal mixing chambers 108 and 110 through contiguous, generally upwardly facing inlet openings 146 and 148 therein.

As shown in FIG. 3, a hopper sand gate in the form of a horizontal metal plate 150 is supported for sliding movement between the upper hopper section 136 and the intermediate hopper extension 137 to selectively open and close the conduit defined thereby. The sand gate slides within a guide 152 and is moved by a pneumatic cylinder 154 supported by an arm 156 extending horizontally from the upper hopper section 136. The output piston rod 158 of the cylinder 154 is attached to the plate 150 by a pivotal connection 160. The rearward end of the cylinder 154 has a collar 161 and an adjusting screw 162 for adjusting the range of movement of the plate 150.

The pneumatic cylinder 154 is coupled to air supply hoses (not shown) which extend into the pump base 124. These air supply hoses are coupled to a source of pressurized air through a solenoid operated valve. The plate 150 forming the hopper sand gate can be opened and closed by actuating the valve which controls the cylinder 154. By opening the hopper sand gate for a preselected length of time a pre-determined amount of sand can be introduced into each of the horizontal chambers 108 and 110.

Figure 10:
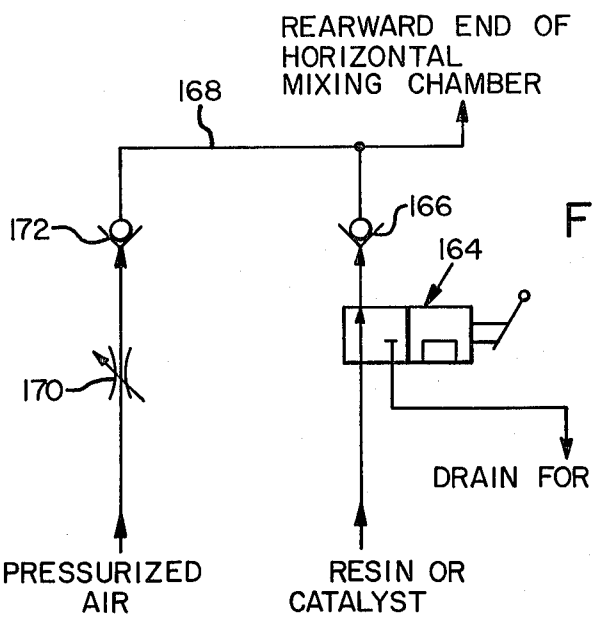
FIG. 10 is a hydraulic schematic diagram illustrating one suitable form of an injection assembly for introducing the liquid binder ingredients.

The injection assemblies 104 and 106 (FIG. 4) introduce liquid resin and liquid catalyst into the rearward ends of the horizontal mixing chambers 108 and 110 respectively. FIG. 10 is a hydraulic schematic diagram illustrating one suitable form of the injection assemblies 104 and 106. They may be constructed with any suitable combination of readily available valves, pipes, pipe tees, elbows, etc., made of a material, such as polyvinyl chloride, that will not react with the liquid binder ingredients. Liquid binder ingredient (either resin or catalyst) is supplied by a positive displacement pump mounted in the pump base 124 to a three-way, two position manually operable valve 164. When the valve 164 is in its feed position the liquid binder ingredient flows through a check valve 166 into a pipe 168 extending through the side wall of one of the horizontal mixing chambers. Pressurized air is supplied from the pump base 124 through a variable flow control valve 170, through a check valve 172 and into the pipe 168 upstream from the point of entry of the liquid binder ingredient. The pressurized air rapidly forces the liquid binder ingredient into the mixing chamber.

Injecting the liquid binder ingredients into the horizontal mixing chambers in this fashion is necessary because of the high speed rotation of the horizontal blade assemblies 112 and 114. It prevents the pipes 168 of the injection assemblies 104 and 106 from becoming clogged with sand. The liquid binder ingredients are more evenly distributed throughout the sand which is being rapidly conveyed forwardly, as described hereafter. The check valves 166 and 172 prevent back flow. By operating the positive displacement pumps for preselected lengths of time predetermined quantities of liquid binder ingredients can be injected into the mixing chambers. The three-way valve 164 of either injection assembly can be switched to its bleed position so that liquid binder ingredient can be drained directly therefrom for calibrating the positive displacement pump which supplies liquid binder ingredient thereto.

From the foregoing, it will be understood that sand and liquid resin are rapidly mixed in the horizontal mixing chamber 108 by its blade assembly 112 to form a first preliminary mixture. Sand and liquid catalyst are simultaneously rapidly mixed in the other horizontal mixing chamber 110 by its blade assembly 114 to form a second preliminary mixture. The first and second preliminary mixtures are then discharged into the vertical mixing head 116 where they are rapidly mixed to form a final mixture, which is discharged into the mold box 22.

The details of the construction of the blade assembly 114, the manner in which it is rotatably mounted in the mixing chamber 110, and the manner in which it mixes and conveys the second preliminary mixture will now be described. The same description is applicable to the blade assembly 112, the mixing chamber 108, and the first preliminary mixture, and therefore it will not be repeated. However, it should be pointed out that the blade assemblies 112 and 114 rotate in opposite directions as shown by the arrows in FIG. 6. Accordingly, where a blade of one assembly is angled or pitched relative to a plane extending normally through the shaft of that blade assembly, the corresponding blade of the other blade assembly is oppositely pitched.

Figure 7:
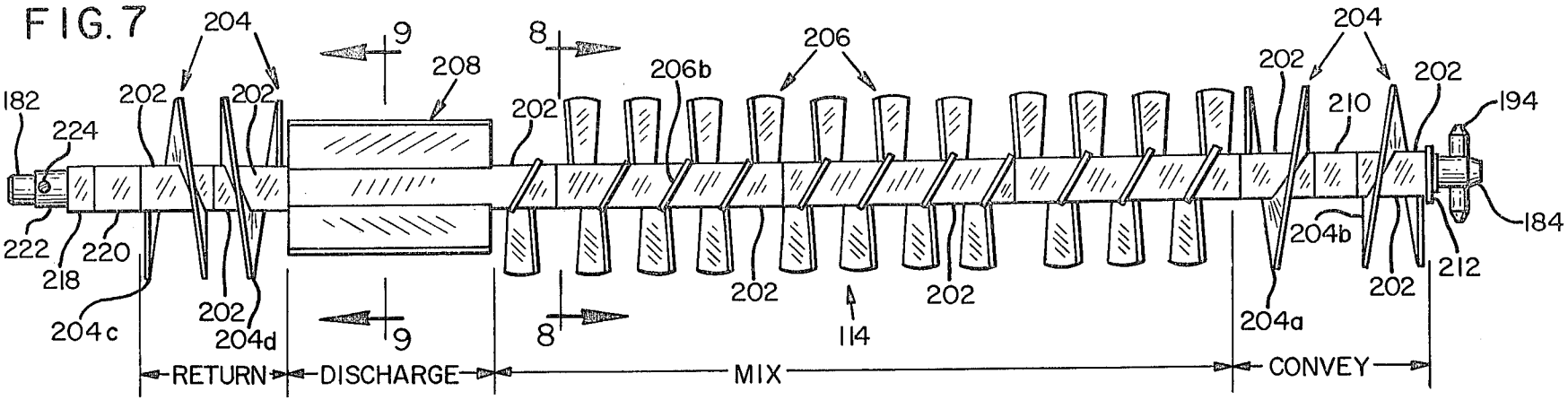
FIG. 7 is an enlarged side elevational view of one of the horizontal mixing blade assemblies of the apparatus of FIG. 3.
Figure 8:
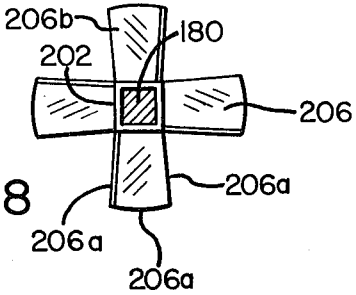
FIG. 8 is a sectional view of the blade assembly of FIG. 7 taken along line 8—8 of FIG. 7.
Figure 9:
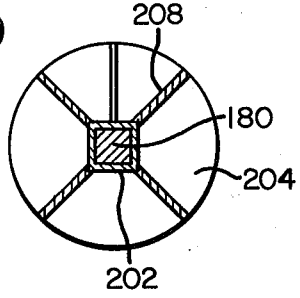
FIG. 9 is a sectional view of the blade assembly of FIG. 7 taken along line 9—9 of FIG. 7.

Referring generally to FIGS. 7, 8 and 9, the horizontal blade assembly 114 includes an elongate square shaft 180 which has been turned on a lathe to form rounded forward and rearward ends 182 and 184. The forward shaft end 182 is journalled in a bearing 186 (FIGS. 3 and 4) bolted to a front bearing plate 188 detachably mounted over the forward end opening of the mixing chamber 110. Threaded studs 190 extend from the forward oval plate 126 through corresponding holes in the front bearing plate 188. Hand nobs 192 are screwed over the studs 190 to hold the bearing plate 188 rigidly in position.

Referring again to FIG. 7, the rearward shaft end 184 has a drive pin 194 which extends therethrough normal to the axis of the shaft 180. The rearward shaft end 184 is removably received by a slotted stub shaft (not shown) of a suitable motor means such as a three phase, three horsepower electric motor 196 (FIG. 3) mounted to the rearward end of the mixing chamber 110 by a motor mount 198.

The motor 196 rotates the shaft 180 and the blades carried thereby at high speed, preferably at approximately 1200 revolutions per minute. Satisfactory results can be achieved if the shaft 180 is rotated at from about 300 rpm to 1500 rpm. The horizontal blade assembly 112 inside of the mixing chamber 108 is similarly rotated at high speed by a motor 200 (FIG. 1).

It should be noted that no transmission is necessary to couple the motor 196 to the shaft 180. In addition, the horizontal blade assembly 114 can be quickly removed from the mixing chamber 110 for maintenance or repair by removing the hand nobs 192 and pulling the bearing plate 188 forwardly.

Referring again to FIGS. 7, 8 and 9, slid onto the shaft 180 are individual segments of square tubing 202 to which are welded helical blades 204, paddle blades 206, and flinger blades 208. Damaged or worn blades can be rapidly replaced merely be sliding the tubing segments 202 off of the shaft 180 so that substitutes can be slid on in their places.

At the rearward end of the shaft 180 are two helical blades **204*a* and 204*b* welded to individual tubing segments 202 which are axially separated by a spacer 210, also made of square tubing. A lip 212 welded to the shaft 180 serves to prevent rearward sliding of the tubing segments 202**.

The inside diameter of the horizontal mixing chamber 110 is approximately six and one-half inches. The outside diameter of the helical blades 204 is approximately six and one-quarter inches. During rotation of the shaft 180, sand from the hopper 134 enters the mixing chamber 110 through its inlet opening 148 and is deposited between the helical blades **204*a* and 204*b* which rapidly convey the sand forwardly. It has been found that the spacer 210 is necessary or else during high speed rotation of the shaft 180 the helical blades 204*a* and 204*b* will throw sand upwardly toward the inlet opening 148, thereby preventing sand from being fed into the mixing chamber 110 at a sufficient rate to permit the mold box 22 to be rapidly filled. In addition, the edges of the helical blades 204 positioned closely adjacent to the cylindrical inner surface of the horizontal mixing chamber 110 scrape mixed sand and catalyst from such inner surface. Preferably the helical blades 204** are completely coated with a flame sprayed wear resistant material such as metal alloy containing tungsten carbide.

Forward of the helical blades **204*a* and 204*b* are a plurality of paddle blades 206 (FIG. 7) which are welded to a plurality of tubing segments 202. The paddle blades 206 are all similarly pitched at an acute angle of approximately thirty degrees with respect to a plane extending normally to the axis of the shaft 180. The paddle blades 206 are radially spaced at ninety degree intervals (FIG. 8) and are axially staggered (FIG. 7) so that each paddle blade overlaps and immediately preceding paddle blade to form a skeletal helix. During high speed rotation of the shaft 180 the paddle blades 206 rapidly mix sand and catalyst and convey the mixture forwardly. Due to centrifugal forces the sand/catalyst mixture is thrown outwardly against the cylindrical inner surface of the mixing chamber 110. This permits wide variations in throughput. Quantities of sand and binder ingredient ranging from relatively small to relatively large can be thoroughly mixed. The outer edges 206*a* of the paddle blades are curved and are spaced approximately one-eighth of an inch from the cylindrical inner surface of the horizontal mixing chamber 110. This enables the paddle blades to scrape mixed sand and catalyst from such inner surface during rotation of the shaft 180. Preferably the outer paddle blade edges 206***a* and the forward paddle blade surfaces 206*b* which impel the sand/catalyst mixture forwardly are also coated with a wear resistant material.

It should be noted that the shaft 180 carries no oppositely pitched cam blades for throwing sand rearwardly. Due to the high speed at which the shaft 180 is rotated, thorough mixing is achieved without the necessity of using such blades. Sand and liquid binder ingredient can be rapidly routed through the horizontal mixing chambers. Since the chambers can be rapidly purged it is possible to quickly change the types and quantities of materials to be mixed.

Forward of the paddle blades 206 are the rectangular flinger blades 208, which are welded to a tubing segment 202 at ninety degree spaced intervals so that they extend radially outwardly (FIG. 9). As shown in FIG. 6 the horizontal mixing chambers 108 and 110 have contiguous downwardly facing discharge openings 214 and 216 adjacent their forward ends. The flinger blades 208 of the respective horizontal blade assemblies 112 and 114 are positioned above the discharge openings 214 and 216. During counter rotation of the horizontal blade assemblies their respective flinger blades rapidly throw sand/liquid binder ingredient mixture downwardly through the discharge openings into the vertical mixing head 116.

Referring again to FIG. 7, forward of the flinger blades 208 are a pair of return helical blades 204*c* and 204*d* also welded to separate tubing segments 202. They are the same as the helical blades 204*a* and 204*b* except that they are oppositely spiralled so that during rotation of the shaft 180 in the direction indicated by the arrow in FIG. 7, sand/catalyst mixture will be conveyed rearwardly thereby toward the intermediate portion of the shaft 180. This serves to protect the bearing 186 from damage due to sand entering the same.

Forward of the helical blades 204*c* and 204*d* are square tubular spacers 218 and 220. A bushing 222 is slid over the forward rounded shaft end 182. The bushing has a locking screw 224 for fixing the bushing in position on the shaft 180 and preventing forward movement of the spacers 218 and 220 and the tubing segments 202.

Turning now to a description of the structure and operation of the vertical mixing head 116, reference is made to U.S. Pat. No. 4,037,826, the disclosure of which is specifically incorporated herein. As shown in FIGS. 3, 4 and 6 the vertical mixing head 116 includes a vertically extending mixing chamber 230 positioned underneath the forward ends of the horizontal mixing chamber 108 and 110. The vertical mixing chamber 230 has an upper cylindrical portion 232, an intermediate frustoconical portion 234, and a lower cylindrical portion 236 having a lesser diameter than the upper cylindrical portion 232.

The lower support plate 132 welded to the undersides of the forward ends of the horizontal mixing chambers 108 and 110 has a pair of discharge openings 238 and 240 located beneath the discharge openings 214 and 216 of the horizontal mixing chambers 108 and 110. The vertical mixing chamber 230 is secured to the support plate 132 beneath the discharge openings 238 and 240 thereof. The upper end of the vertical mixing chamber 230 defines an inlet opening sufficiently large to receive the first and second preliminary mixtures discharged through the discharge openings 214 and 216 of the horizontal mixing chambers 108 and 110 and through the discharge openings 238 and 240 through the support plate 132.

The vertical mixing chamber 230 is provided with an outer mounting flange 242 at its upper end. The flange 242 has a plurality of holes through which extend threaded studs 244 which are fixedly secured at one end to the bottom of the support plate 132. Hand nobs 246 are screwed over the studs 244 to clamp the flange 242 and the vertical mixing chamber 230 to the support plate 132. By unscrewing the hand nobs 246 the vertical mixing chamber 230 may be readily removed in order to service the blade assembly of the mixing head 116 hereafter described.

A safety switch (not shown) is mounted on the support plate 132 so that its actuating member is operated by contact with the mounting flange 242 when the vertical mixing chamber 230 is mounted on the support plate 132. This switch disables the operation of the motor which drives the vertical mixing head 116 and the motors 196 and 200 which drive the horizontal blade assemblies 114 and 112 when the mixing chamber 230 is removed from the support plate 132 for any reason, such as for cleaning purposes. It should be noted that the support plate 132 extends as a cover over the top of the vertical mixing chamber 230. The lower end of the vertical mixing chamber 230 defines a discharge opening 248 through which the final mixture is downwardly discharged into the mold box 22.

A vertical blade assembly generally designated 250 extends centrally through the vertical mixing chamber 230. The vertical blade assembly includes a hollow rotor shaft 252 which is connected at its upper end to a drive shaft 254 extending into the rotor shaft. A pin 256 extends through openings in the sides of both shafts 252 and 254 to couple them together. An annular flange 258 at the top of the rotor shaft 252 closes an opening 260 in the support plate 132 through which the drive shaft 254 extends to prevent mixed material from exiting through such opening. The drive shaft 254 is journaled in a rotary bearing 262 bolted to the upper side of the support plate 132. The upper end of the drive shaft 254 is connected by coupling 266 to the output shaft 268 of a double gear reduction transmission 270 (FIG. 3) mounted on the upper support plate 130. The input shaft of the transmission 270 is connected to the stub shaft of a suitable motor means such as a vertically oriented three-phase, ten horsepower electric motor 272 mounted to the top of the transmission 270.

The rotor shaft 252 is rotated at high speed in the direction indicated by the arrow in FIG. 6 by the motor 272, preferably at about 420 rpm, so that the first and second preliminary mixtures are rapidly mixed by the vertical blade assembly 250. Satisfactory results may be achieved if the vertical blade assembly 250 is rotated at from about 300 rpm to about 800 rpm.

Referring again to FIG. 6, welded to the rotor shaft 252 adjacent its upper end is a horizontal circular baffle plate 274. During rotation of the rotor shaft 252 the first and second preliminary mixtures are fed through the discharge openings 238 and 240 onto the rotating baffle plate 274. The mixtures are thrown outwardly by the baffle plate against the front surfaces of four annularly spaced deflector blades 276 formed integrally with the outer edge of the baffle blades. The deflector blades 276 are bent so that they extend at an acute angle of approximately 25 degrees with respect to the plane of the baffle blade 274. Material thrown outwardly from the baffle plate 274 is deflected downwardly by the deflector blades 276. The baffle plate prevents material from traveling down the outer surface of the rotor shaft 252 where it would not be thoroughly mixed.

A first pair of longitudinal mixing blades 278 and a second pair of longitudinal mixing blades 280 are attached by vertically spaced horizontally extending support arms 282 and 284, respectively, to the rotor shaft 252. The first longitudinal mixing blades 278 extend along substantially the entire length of the cylindrical inner surface of the upper cylindrical portion 232 and are uniformly spaced a short distance from such inner surface. The second pair of longitudinal mixing blades 280 are shorter than the blades 278 and extend only a distance equal to approximately one-half the length of the upper cylindrical portion 232. These second longitudinal mixing blades 280 are spaced approximately ninety degrees from the first longitudinal mixing blades 278 and are uniformly spaced a short distance from the inner surface of the cylindrical portion 232. Both pairs of longitudinal mixing blades 278 and 280 may be spaced a distance of approximately one-quarter of an inch from the inner surface of the cylindrical portion 232 to enable both to scrape mixed material from such inner surface while mixing the material within the vertical mixing chamber 230.

The longitudinal mixing blades 278 and 280 are preferably one-quarter of an inch in radial width and one-half of an inch in thickness. As a result of using such narrow mixing blades 278 and 280 and as a result of the fact that such blades are supported by spaced support arms 282 and 284, very little mixed material sticks to such blades. Also, the scraping action of the blades prevents material build up on the inner surface of the upper cylindrical portion 232 of the vertical mixing chamber 230.

A pair of lower convoluted mixing blades 286 and 288 spiral downwardly and inwardly from the lower ends of the longitudinal mixing blades 278. The lower ends of the convoluted mixing blades 286 and 288 are connected to the outer ends of a pair of radially extending impeller blades 290 and 292 which are welded at their inner ends to the lower end of the rotor shaft 252. The impeller blades 290 and 292 are angled or pitched at an actue angle of twenty degrees with respect to a plane extending normally through the rotor shaft 252. This allows them to impel the final mixture through the discharge opening 248 at the lower end of the vertical mixing chamber 240. The convoluted mixing blades 286 and 288 are also uniformly spaced a short distance from the inner surface of the frusto-conical portion 234 for scraping purposes. They perform three functions, namely mixing, scraping, and impelling mixed material downward due to their spiral shape.

As shown in FIGS. 3, 4 and 6 a mixing head sand gate in the form of a horizontal metal plate 294 is supported for sliding movement at the bottom of the vertical mixing chamber 230 to selectively close and open the discharge opening 248. The plate 294 slides within a guide 296 positioned between the frusto-conical portion 234 and the lower cylindrical portion 236 of the vertical mixing chamber 230.

Referring to FIG. 4, the plate 294 forming the mixing head sand gate is moved by a pneumatic cylinder 298 whose output piston rod 300 is received by a fork-like coupling 302 attached to the plate 294. A removable pin 304 is inserted through vertically aligned holes in the coupling 302 and the rod 300 to connect the same. The cylinder 298 is supported by an arm 306 whose upper end is welded to the side wall of the horizontal mixing chamber 110. The cylinder 298 is coupled to hoses (not shown) which extend into the pump base 124 and are coupled to a source of pressurized air through a solenoid operated valve. The mixing head sand gate can be opened to allow sand to be discharged from the vertical mixing chamber 230 by actuating the solenoid operated valve controlling the cylinder 298 to cause the plate 294 to be slid to the right (FIG. 4). A sand gate guard 308 surrounds the guide 296 to prevent injury to an operator when the plate 294 is slid to its closed position to the left. The spacing between the impeller blades 290 and 292 and the plate 294 (FIG. 6) is on the order of about one-thirty second of an inch or less so that such blades completely remove any mixed material which tends to be deposited on the plate.

A forwardly facing control panel 310 is mounted to the arm 306. A plurality of switches are mounted on the control panel for actuating the motors, pumps, solenoid operated valves, etc. incorporated in the mixing apparatus.

A typical operation of the mixing apparatus 10 of the present invention involves first closing the mixing head sand gate 294 and then starting the motors 196, 200 and 272. The hopper sand gate 150 is momentarily opened to allow a predetermined amount of sand to be introduced into the horizontal mixing chambers 108 and 110. Simultaneously predetermined amounts of resin and catalyst are introduced into the horizontal mixing chambers 108 and 110 through the injection assemblies 104 and 106. The sand and liquid binder ingredients are rapidly mixed in the respective horizontal mixing chambers to form the first and second preliminary mixtures. These preliminary mixtures are conveyed forwardly and discharged into the vertical mixing head 116. After approximately three to four seconds the mixing head sand gate 294 is opened to allow the final mixture to be discharged from the vertical mixing head 116 into the mold box 22. It takes approximately four to five seconds for a typical quantity of sand, e.g. eighty pounds, to be rapidly routed through the mixing apparatus while being thoroughly mixed with the proper quantities of resin and catalyst. This allows mixtures to be produced with hardening times of as low as thirty seconds. Heretofore such rapidly hardening mixtures have presented problems in those mixers containing low speed horizontal mixing chambers since the sand is not rapidly conveyed through such mixers in contrast to the present invention.

It will be apparent to those skilled in the art that the present invention permits of modification in both arrangement and detail. For example, the horizontal mixing chambers may be suspended from an overhead turntable. The relative sizes of the various mixing chambers can be varied to meet the output requirements of a particular molding operation. The hopper assembly can be modified so that four different types of sand, e.g. facing, backing, etc., can be selectively introduced into the horizontal mixing chambers. The injection assemblies can be modified to permit three liquid binder ingredients, namely two catalysts and one resin, to be simultaneously injected into the horizontal mixing chambers. Controls can be provided for selectively injecting different types of liquid binder ingredients. The mixing apparatus can be inserted into an assembly line molding operation and controlled by a solid state programmable control device so that it will automatically fill mold boxes of varying heights with preselected sand mixtures consisting of various types and amounts of sand and liquid binder ingredients. Such modifications, as well as others, are within the spirit and scope of the present invention.

We claim:

1. Apparatus for combining high speed horizontal and high speed vertical continuous mixing of sand and binder ingredients for mold making purposes comprising:

a pair of side-by-side horizontally extending cylindrical first mixing chambers having contiguous upwardly facing inlet openings adjacent their rearward ends and contiguous downwardly facing discharge openings adjacent their forward ends;

first feeder means for introducing sand into the first mixing chambers including a hopper which extends vertically above the first mixing chambers and defines a conduit which communicates with their inlet openings, and first gate means normally sealing the conduit and actuable to open the conduit to allow a predetermined amount of sand supplied to the hopper to flow into each of the first mixing chambers;

second feeder means for introducing a first liquid binder ingredient into one of the first mixing chambers and a second liquid binder ingredient into the other one of the first mixing chambers, the second feeder means including pipe means adjacent the rearward ends of the first mixing chambers for injecting liquid binder ingredient into the chambers, means for supplying liquid binder ingredient to the pipe means, and means for supplying air under pressure to the pipe means for forcing the liquid binder ingredient into the first mixing chambers;

a pair of first shafts extending horizontally and centrally one through each of the first mixing chambers, means for rotatably supporting the first shafts including front bearing plates which seal the forward ends of the first mixing chambers and means for detachably mounting the front bearing plates to the forward ends of the first mixing chambers, each first shaft carrying helical blades at each end for conveying sand towards the intermediate portions of the first mixing chambers, a plurality of fixed similarly pitched paddle blades for mixing the sand and the first liquid binder ingredient in the one first mixing chamber to form a first preliminary mixture and for mixing the sand and the second liquid binder ingredient in the other first mixing chamber to form a second preliminary mixture and for conveying the first and second preliminary mixtures forwardly, and a plurality of radially extending flinger blades for discharging the first and second preliminary mixtures out of the first mixing chambers through their discharge openings;

first motor means for rotating the first shafts at from about 300 revolutions per minute to about 1500 revolutions per minute;

a vertically extending second mixing chamber positioned underneath the forward portions of the first mixing chambers, the second mixing chamber having an inlet opening at its upper end sufficiently large to receive the first and second preliminary mixtures discharged from the first mixing chambers and a discharge opening at its lower end;

means for detachably securing the second mixing chamber underneath the forward portions of the first mixing chambers so that the inlet opening of the second mixing chamber is underneath the discharge openings of the first mixing chambers;

a second shaft extending vertically and centrally through the second mixing chamber, means for rotatably supporting the second shaft, a plurality of blades fixed to the second shaft including upper blades extending vertically along substantially the entire length of a cylindrical first inner surface of the second mixing chamber to mix the first and second preliminary mixtures and scrape them from the first inner surface during rotation of the second shaft, vertically spaced support arms for fixing upper blades to the second shaft and lower blades which spiral downward and inward from the lower ends of the upper blades to further mix the first and second preliminary mixtures and scrape them from a frusto-conical second inner surface of the second mixing chamber to form a final mixture and to impel the final mixture downwardly through the discharge opening of the second mixing chamber during rotation of the second shaft;

second motor means for rotating the second shaft at from about 300 revolutions per minute to about 800 revolutions per minute; and second gate means normally sealing the discharge opening of the second mixing chamber and actuable to open the same to allow the final mixture to be discharged from the second mixing chamber.

2. Mixer apparatus, comprising:

at least one horizontally extending cylindrical mixing chamber having an inlet opening adjacent its rearward end and a discharge opening adjacent its forward end;

feeder means for introducing materials to be mixed into said mixing chamber through said inlet opening;

a rotatable shaft extending centrally through said mixing chamber;

means for rotating said shaft; and blade means mounted on said shaft for mixing said materials in said mixing chamber, conveying said materials forwardly toward the forward end of said mixing chamber and discharging said materials from said mixing chamber through said discharge opening therein, said blade means comprising helical blades mounted on said shaft adjacent said inlet opening for conveying said materials forwardly, a plurality of fixed similarly pitched paddle blades mounted on said shaft forwardly of said helical blades for mixing said materials and conveying the same forwardly, and a plurality of radially extending flinger blades mounted on said shaft forwardly of said paddle blades and adjacent said discharge opening for discharging said materials through said discharge opening.

3. Mixer apparatus as in claim 2, wherein the outer edges of said helical blades and the outer edges of said paddle blades are each positioned closely adjacent to the inner surface of said cylindrical mixing chamber.

4. Mixer apparatus as in claim 2, wherein said feeder means comprises a hopper which extends vertically above said mixing chamber and defines a conduit which communicates with said inlet opening; and gate means normally sealing said conduit and actuable to open said conduit to allow a predetermined amount of granular material supplied to said hopper to flow into said mixing chamber.

5. Mixer apparatus as in claim 4, wherein said feeder means further comprises pipe means adjacent said rearward end of said mixing chamber for injecting liquid material into said chamber;

means for supplying said liquid material to said pipe means; and means for supplying air under pressure to said pipe means for forcing said liquid material into said mixing chamber.

6. Mixer apparatus as in claim 2, further comprising a vertically extending cylindrical second mixing chamber adjacent said forward end of said horizontally extending mixing chamber and having an inlet opening at its upper end for receiving the materials discharged from said horizontally extending mixing chamber and a discharge opening at its lower end;

a second rotatable shaft extending vertically and centrally through said second mixing chamber;

means for rotating said second rotatable shaft; and second blade means mounted on said second rotatable shaft for mixing the materials in said second mixing chamber and impelling them downwardly through its discharge opening.

7. Mixer apparatus as in claim 6, wherein said second blade means comprise upper blades extending vertically along substantially the entire length of the inner surface of said second mixing chamber for mixing the materials therein and for scraping said materials from said inner surface thereof during rotation of said second rotatable shaft;

vertically spaced support arms for fixing said upper blades to said second rotatable shaft; and lower blades which spiral downwardly and inwardly from the lower ends of said upper blades for further mixing the materials and scraping them from the surface of said second mixing chamber and for impelling said materials downwardly through said discharge opening of said second mixing chamber during rotation of said second rotatable shaft therein.

8. Mixer apparatus as in claim 7, further comprising second gate means normally sealing the discharge opening of said second mixing chamber and actuable to open the same to allow the materials mixed within said second mixing chamber to be discharged therefrom.

* * * * *